United States Patent [19]

Journet et al.

[11] Patent Number: 5,044,092

[45] Date of Patent: Sep. 3, 1991

[54] AUTOMATED METHOD FOR THE CYCLIC OPERATION OF A CENTRIFUGAL DRIER

[75] Inventors: Gérard Journet, Coutiches; Nicolas Francou, Hellemmes, both of France

[73] Assignee: Fives-Cail Babcock, Montreuil, France

[21] Appl. No.: 542,154

[22] Filed: Jun. 21, 1990

[30] Foreign Application Priority Data

Jun. 29, 1989 [FR] France ..... 89 08714

[51] Int. Cl.[5] ..... F26B 5/08

[52] U.S. Cl. ..... 34/8; 34/43; 34/56; 210/781

[58] Field of Search ..... 34/8, 58, 184; 494/1, 494/7-10, 36, 37; 210/772, 781

[56] References Cited

U.S. PATENT DOCUMENTS 1,652,680 12/1927 Olsen ..... 210/781 X 2,682,488 6/1954 Kochli et al. ..... 210/781

*Primary Examiner*—Henry A. Bennet

*Attorney, Agent, or Firm*—Collard, Roe & Galgano

[57] ABSTRACT

A method for the automatic operation of a centrifugal drier comprising a rotary screening basket having a cylindrical wall and which is operated cyclically in successive cycles, each cycle comprising the steps of rotating the basket to generate a centrifugal force, charging a product to be dried into the rotating basket through an open valve, the centrifugal force causing the product to form a layer of increasing thickness along the cylindrical wall, closing the valve to discontinue charging the product when the layer thickness has attained a first control value lower than that of the layer thickness corresponding to an imposed value of the charge in the basket, then measuring the maximum thickness of the layer, comparing said measured maximum layer thickness with a second control value corresponding to said imposed value of the charge in the basket, and generating a new value for the first control value as a function of the difference between the measured maximum layer thickness and the second control value.

2 Claims, 2 Drawing Sheets

AUTOMATED METHOD FOR THE CYCLIC OPERATION OF A CENTRIFUGAL DRIER

BACKGROUND OF THE INVENTION

The present invention relates to a centrifugal drier comprising a rotary cylindrical screening basket and operated cyclically in successive, repetitive cycles in the course of which a product to be dried is charged into the basket under control of a device which interrupts the feeding of the product into the basket when the layer of the product on the cylindrical wall of the rotating basket has reached a predetermined thickness, the product is then partially dried initially as the basket rotates and particulate solid material contained in the product is retained on the basket wall while liquid is centrifugally separated from the product, the partially dried product is washed with a washing liquid projected by an array of orifices or atomizing nozzles disposed in the interior of the basket, and the washed product is finally completely dried, discharged from the basket and removed. Such centrifugal driers have been used in the sugar industry for separating sugar crystals (the particulate solid material) from massecuite (product to be dried).

Each operating cycle of such centrifugal driers is defined by a certain number of parameters, such as acceleration and deceleration of the basket rotation, as well as timing, etc. At the present time, each operating parameter is entered separately into the computer which automatically operates the drier, either by the manufacturer or by the operator, and these parameters are then adjusted empirically on the basis of the operating experience.

In present centrifugal drier installations, certain parameters, such as the time available for each cycle and the volume of the washing liquid utilized, are functions of the charge in the basket. Since it is difficult to measure this charge, one has attempted to maintain the same constant and equal to a predetermined optimum value. For this purpose, it has been proposed to arrange a sensor in the interior of the basket to sense and measure the thickness of the layer of the charged product, which is forced against the cylindrical wall of the basket during rotation thereof, due to the generated centrifugal force. When the sensed layer thickness has reached a predetermined control value, the valve through which the product is charged into the basket is closed. For various reasons, particularly because the product to be dried is not distributed uniformly over the entire height of the cylindrical basket wall during the charging of the basket, the layer thickness measured by the sensor continues to increase for a certain time even after the valve has been closed. The final maximum thickness of the layer exceeds the control value, and the difference therebetween varies according to the properties of the product. Therefore, the same control value causing the valve to be closed and charging of the product into the basket to be discontinued may produce different charges in the successive operating cycles.

SUMMARY OF THE INVENTION

It is the primary object of this invention to overcome this disadvantage.

This and other objects are accomplished according to the invention in a method for the automatic operation of a centrifugal drier comprising a rotary screening basket having a cylindrical wall and which is operated cyclically in successive cycles, each cycle comprising the steps of rotating the basket to generate a centrifugal force, charging a product to be dried into the rotating basket through an open valve, the centrifugal force causing the product to form a layer of increasing thickness along the cylindrical wall, closing the valve to discontinue charging the product when the layer thickness has attained a first control value lower than that of the layer thickness corresponding to an imposed value of the charge in the basket, then measuring the maximum thickness of the layer, comparing said measured maximum layer thickness with a second control value corresponding to said imposed value of the charge in the basket, and generating a new value for the first control value as a function of the difference between the measured maximum layer thickness and the second control value. Thus, at the end of each operating cycle, a new control value for closing the charging valve is established on the basis of the difference between the measured layer thickness value and a predetermined maximum layer thickness value attained during the preceding operating cycle. For example, one may add to the prior control value the algebraic difference between the measured and predetermined maximum values of the layer thickness.

It is also possible to establish a curve defined by the variations of the layer thickness as charging of the product into the basket proceeds in time during each cycle, and to determine the new value for the first control value on the basis of the curve established during the preceding cycle.

BRIEF DESCRIPTION OF DRAWING

The above and other objects, advantages and features of the present invention will become more apparent from the following description of a now preferred embodiment, in conjunction with the accompanying drawing wherein.

DETAILED DESCRIPTION OF PREFERRED EMBODIMENTS

Figure 1:
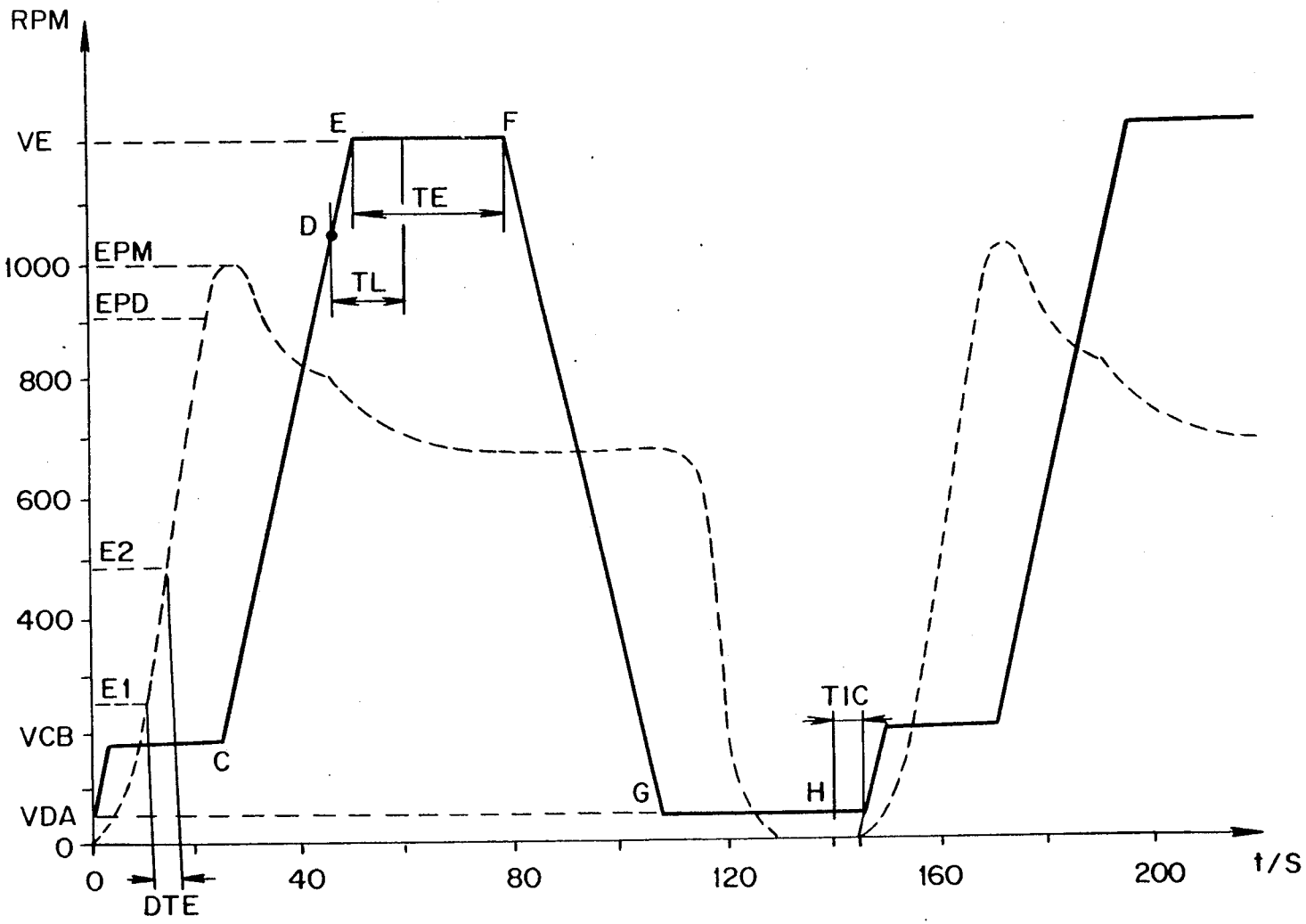
FIG. 1 is a graph showing an operating cycle of a centrifugal drier of the indicated type, including a curve indicating the variations of the product layer thickness in the rotating drier basket as a function of the time.

Referring first to FIG. 1, the abscissa of the graph shows the time in seconds and the ordinate is the speed of the rotation of the screening basket in minutes. The illustrated operating cycle comprises stage of acceleration AB, stage BC of charging the basket with the product containing a particulate solid material at constant rotary speed VC, stage CE of accelerating the rotary basket for centrifugally separating liquid from the solid material to obtain the solid material in predried form, a stage beginning at D of washing the predried solid material with a washing liquid, maintaining the basket at constant rotary speed VE in stage EF until the solid material has been completely dried, stage of deceleration FG and stage GH of discharging the dried solid material from the basket at low constant rotary speed VD.

At the end of each operating cycle, the time in seconds available for the following cycle is determined on the basis of the following forumla:

$$TCD = \frac{3600 \times N \times Ch}{Q} - TIC$$

wherein

N is the number of available driers,

Ch is the imposed charge of the basket in cubic meters,

Q is the flowrate of the product charged into the basket in cubic meters/hour, and TIC is a safety margin of 2 to 30 seconds provided between the end of one cycle and the beginning of the following cycle.

value of Q

The value of Q may be derived, for example, from a system controlling a production plant upstream of the drier or from a level indicator in a storage tank or a mixer feeding the drier with the mixed product.

If calculated value TCD is more or less than the time tH−tA of the preceding cycle, the time of the duration TE of stage EF of completely drying the solid material is fixed to be respectively shorter or longer so that the total time of the operating cycle is equal to TCD while the times of the other stages of the cycle remain constant. In other words, the drying time TE is fixed as a function of the time available for the following cycle to reduce the time interval between two successive cycles to a minimum. At the same time, the quantity of the washing liquid to be used in the following cycle is determined at a new level as a function of the duration of the complete drying stage.

Figure 2:
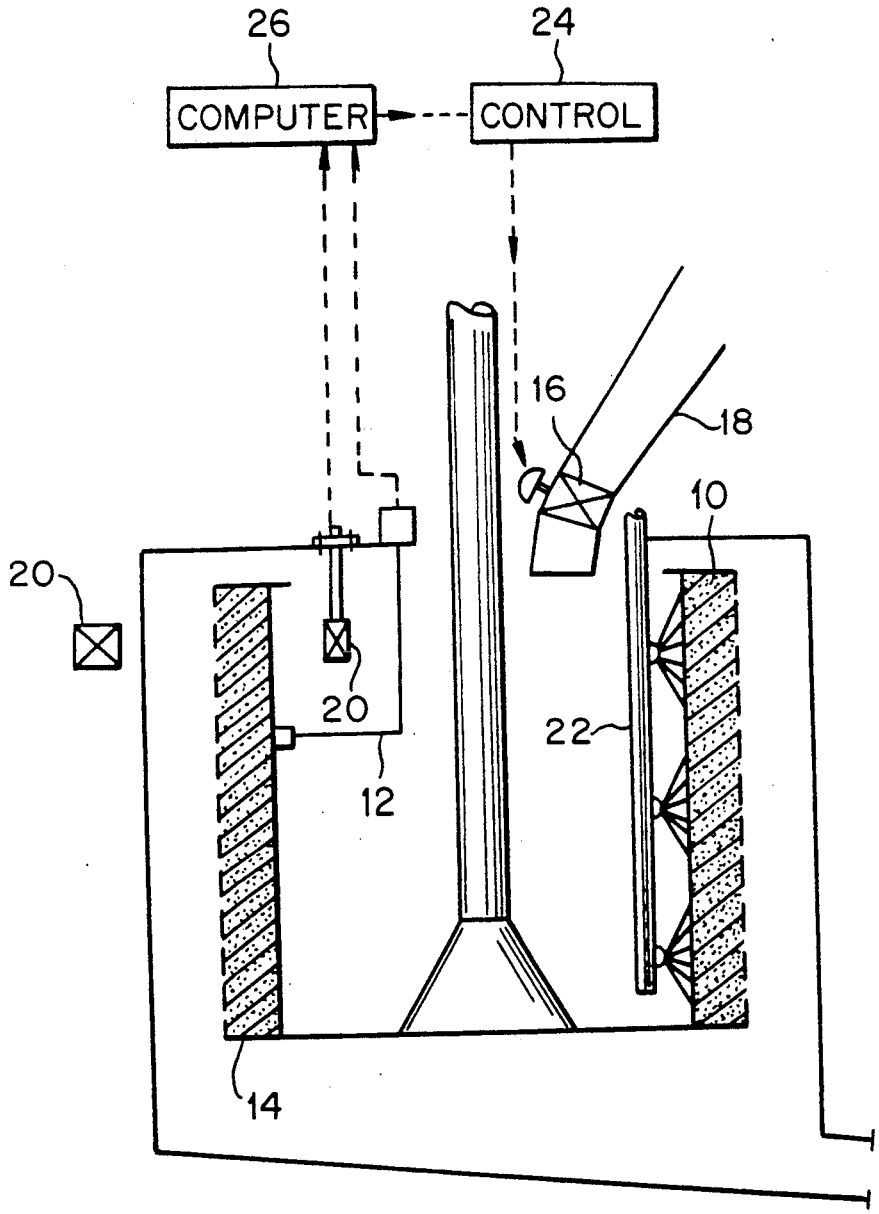
FIG. 2 is a schematic illustration of the drier in vertical section.

As shown in FIG. 2, the washing liquid is projected onto layer 14 of the partially dried product in rotary cylindrical screening basket 10 by array 22 of spraying nozzles. Practically, the flowrate of the washing liquid is maintained constant and the new value for the duration TL of the washing stage will be fixed.

To maintain the charge in basket 10 at imposed value Ch, a product layer thickness sensor 12 is placed in the interior of the basket to sense and measure the thickness of the layer as it continuously increases during the rotation of the basket under the centrifugal force imposed upon the product as it is charged from feeding chute 18 through open valve 16 into basket 10. As soon as charging of the product has started at the beginning of each operating cycle, sensor 12 is applied to the layer of product 14 building up along the cylindrical wall of the basket to measure its thickness continuously. This thickness increases rapidly until it attains control value EPD which is transmitted to control 24 and causes valve 16 to be closed, thus discontinuing charging of the basket. However, after the valve has been closed, the thickness of the product layer continues to increase because the product tends to rise from the bottom of the basket along its vertical cylindrical wall. Therefore, the maximum layer thickness value EPM reached during the operating cycle exceeds control value EPD, the difference between these two values varying according to the properties of the product to be dried, particularly its viscosity.

According to the invention, a new control value EPD is determined at the end of each cycle by comparing the maximum layer thickness value measured by sensor 12 with theoretical value EPC corresponding to value Ch of the imposed charge. Thus, the difference is calculated on the basis of formula $$E = EPC - EPM$$

to obtain the new value for EPD.

According to a preferred embodiment, the evolution of the curve defined by the variations in the layer thickness during each operating cycle along a time line is used for determining the new value. This curve is shown in broken lines in FIG. 1 and is established on the basis of the data received from sensor 12 or from a gamma-densimeter 20 whose radiation traverses the layer of product 14 to generate a signal corresponding to the thickness of the layer. The slope of the curve is calculated from the start of charging and is compared with that of the curve of the preceding cycle. The calculation may be made, for example, on the basis of slope E1E2 during an interval of time DTE between a first layer thickness E1 and a subsequent layer thickness E2 measured in the course of charging the basket.

All the calculations are made automatically by computer 26 connected to sensor 12 and/or gamma-densimeter 20 to obtain the layer thickness measurement data therefrom and process the same to obtain an output corresponding to the control value which is transmitted to control 24 operating the various elements of the centrifugal drier, such as a motor entraining basket 10 in rotation, valve 16, etc.

At the beginning of the operation of the driers, predetermined control value EPC corresponding to value Ch of the imposed basket charge is introduced in computer 26 by the operator. For the first operating cycle, the computer calculates control value EPD on the basis of formula $$EPD(1) = K.EPC.$$

wherein K is a coefficient chosen by the operator on the basis of experimental results. K may be, for example, 0.8.

For the following operating cycles, the computer utilizes the following formula to obtain each subsequent control value EPD:

$$EPD(n+1) = EPD(n) + K1[\mathbf{EPC} - \mathbf{EPM}(n)] + K2[E1E2(n) - E1E2(n+1)]$$

In this formula, K1 and K2 are coefficients introduced by the operator in the computer memory on the basis of experimental results, K1 being chosen, for example, in the range of 0 to 2 and K2 in the range of 0 to 3; and EPD(n) is the control value utilized in cycle n, EPD(n+1) being the value calculated for the following operating cycle (n+1).

A simplified solution consists of calculating EPD on the basis of the formula:

$$EPD(n+1) = EPD(n) + K3[EPC - EPM(n)],$$

taking into account the evolution of the slope of the curve showing the product layer thickness in the following manner:

If the evolution of the curve slope is positive, i.e. the slope is more steep, and the difference EPC−EMP(n) is also positive, i.e. the charge in the preceding operating cycle is too small, the EPD for the cycle is not modified, i.e. EPD(n+1)=EPD(n). On the other hand, if the evolution of the curve slope is negative, i.e. the slope is more gentle, and the difference EPC−EMP(n) is also negative, i.e. the charge in the preceding cycle is too large, the EPD is modified for the following cycle.

In all other cases, the EPD is calculated on the basis of the above formula.

What is claimed is:

1. A method for the automatic operation of a centrifugal drier comprising a rotary screening basket having a cylindrical wall and which is operated cyclically in successive cycles, each cycle comprising the steps of rotating the basket to generate a centrifugal force, charging a product to be dried into the rotating basket through an open valve, the centrifugal force causing the product to form a layer of increasing thickness along the cylindrical wall, closing the valve to discontinue charging the product when the layer thickness has attained a first control value lower than that of the layer thickness corresponding to an imposed value of the charge in the basket, then measuring the maximum thickness of the layer, comparing said measured maximum layer thickness with a second control value corresponding to said imposed value of the charge in the basket, and generating a new value for the first control value as a function of the difference between the measured maximum layer thickness and the second control value.

2. The method of claim 1, comprising the further step of establishing a curve defined by variations in the layer thickness during the preceding cycle, as charging of the product into the basket proceeds in time during each cycle, and determining the new value for the first control value on the basis of the slope of the curve established during the preceding cycle.

* * * * *